US012163523B1

(12) United States Patent
Ramalingam et al.

(10) Patent No.: US 12,163,523 B1
(45) Date of Patent: Dec. 10, 2024

(54) COMPRESSOR AND VALVE ASSEMBLY

(71) Applicant: Copeland LP, Sidney, OH (US)

(72) Inventors: Srinivasan Ramalingam, Sidney, OH (US); Miles E. Strand, St. Marys, OH (US); Aditya Sakhalkar, Sidney, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/541,828

(22) Filed: Dec. 15, 2023

(51) Int. Cl.

| | |
|---|---|
| ***F04C 29/12*** | (2006.01) |
| ***F04C 18/02*** | (2006.01) |
| ***F04C 28/24*** | (2006.01) |
| ***F04C 28/26*** | (2006.01) |

(52) U.S. Cl.
CPC ..... *F04C 29/12* (2013.01); *F04C 18/0207* (2013.01); *F04C 18/0215* (2013.01); *F04C 28/24* (2013.01); *F04C 28/26* (2013.01); *F04C 29/128* (2013.01)

(58) Field of Classification Search
CPC .... F04C 29/12; F04C 29/128; F04C 18/0207; F04C 18/0215; F04C 28/24; F04C 28/26
See application file for complete search history.

(56) References Cited

U.S. PATENT DOCUMENTS

| | | | |
|---|---|---|---|
| 3,303,988 | A | 2/1967 | Weatherhead |
| 3,777,508 | A | 12/1973 | Imabayashi et al. |
| 4,058,988 | A | 11/1977 | Shaw |
| 4,216,661 | A | 8/1980 | Tojo et al. |
| 4,313,314 | A | 2/1982 | Boyanich |

(Continued)

FOREIGN PATENT DOCUMENTS

| | | | |
|---|---|---|---|
| AU | 2002301023 | B2 | 6/2005 |
| CN | 1137614 | A | 12/1996 |

(Continued)

OTHER PUBLICATIONS

Yanagisawa, M.; Uematsu, T.; Hiodoshi, S.; Saito, M.; and Era, S., "Noise Reduction Technology For Inverter Controlled Scroll Compressors" (2002). International Compressor Engineering Conference. Paper 1578.

(Continued)

*Primary Examiner* — Deming Wan
(74) *Attorney, Agent, or Firm* — Harness, Dickey & Pierce, P.L.C.

(57) ABSTRACT

A compressor includes a scroll and a discharge valve assembly mounted to the scroll. The discharge valve assembly is configured to control fluid flow through a discharge passage. The discharge valve assembly includes a first portion having a backer and a valve member. The first portion includes a discharge opening in communication with the discharge passage. The discharge valve assembly includes a second portion including a body having a top wall, an outer wall and an inner hub. The outer wall is spaced apart from and surrounds the inner hub, defining an inner passage therebetween in communication with the discharge opening. The backer is disposed between the valve member and the second portion. A portion of the outer wall engages the backer. The valve member is deflectable between a closed position restricting fluid flow through the discharge opening and an open position allowing fluid flow through the discharge opening.

20 Claims, 7 Drawing Sheets

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,791,328 A 8/1998 Alexander
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.

(56) References Cited

U.S. PATENT DOCUMENTS 6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,112,046 B2 9/2006 Kammhoff et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
7,429,167 B2 9/2008 Bonear et al.
RE40,554 E 10/2008 Bass et al.
7,484,374 B2 2/2009 Pham et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,827,809 B2 11/2010 Pham et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,020,402 B2 9/2011 Pham et al.
8,025,492 B2 9/2011 Seibel et al.
8,079,229 B2 12/2011 Lifson et al.
8,162,622 B2 4/2012 Shoulders
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,328,543 B2 12/2012 Wilson
8,393,882 B2 3/2013 Ignatiev et al.
8,424,326 B2 4/2013 Mitra et al.
8,505,331 B2 8/2013 Pham et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,068,765 B2 6/2015 Huff
9,080,446 B2 7/2015 Heusler et al.
9,127,677 B2 9/2015 Doepker
9,145,891 B2 9/2015 Kim et al.
9,169,839 B2 10/2015 Ishizono et al.
9,194,395 B2 11/2015 Ginies et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,360,011 B2 6/2016 Perevozchikov et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,605,677 B2 3/2017 Heidecker et al.
9,612,042 B2 4/2017 Sjoholm et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,850,903 B2 12/2017 Perevozchikov
9,869,315 B2 1/2018 Jang et al.
9,879,674 B2 1/2018 Akei et al.
9,885,347 B2 2/2018 Lachey et al.
9,920,759 B2 3/2018 Sung et al.
9,926,932 B2 3/2018 Perevozchikov et al.
9,989,057 B2 6/2018 Lochner et al.
10,066,622 B2 9/2018 Pax et al.
10,087,936 B2 10/2018 Pax et al.
10,088,202 B2 10/2018 Huff et al.
10,094,380 B2 10/2018 Doepker et al.
10,323,639 B2 6/2019 Doepker et al.
10,428,818 B2 10/2019 Jin et al.
10,563,891 B2 2/2020 Smerud et al.
10,724,523 B2 7/2020 Wu et al.
10,815,999 B2 10/2020 Jeong
10,907,633 B2 2/2021 Doepker et al.
10,954,940 B2 3/2021 Akei et al.
10,974,317 B2 4/2021 Ruxanda et al.
11,209,000 B2 12/2021 Moore et al.
11,231,034 B2 1/2022 Funakoshi et al.
11,300,329 B2 4/2022 Yan et al.
11,378,290 B2 7/2022 Locke et al.
11,493,040 B2 11/2022 Zou et al.
11,846,287 B1 12/2023 Gehret et al.
2001/0010800 A1 8/2001 Kohsokabe et al.
2002/0039540 A1 4/2002 Kuroki et al.
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.

(56) References Cited

U.S. PATENT DOCUMENTS

2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0003666 A1 1/2007 Gutknecht et al.
2007/0036661 A1 2/2007 Stover
2007/0110604 A1 5/2007 Peyton
2007/0130973 A1 6/2007 Lifson et al.
2007/0148026 A1 6/2007 Higashi
2007/0194261 A1 8/2007 Kato et al.
2008/0034772 A1 2/2008 Chumley et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0205345 A1 8/2009 Narayanamurthy et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0052437 A1 3/2011 Iitsuka et al.
2011/0135509 A1 6/2011 Fields et al.
2011/0174014 A1 7/2011 Scarcella et al.
2011/0206548 A1 8/2011 Doepker
2011/0243777 A1 10/2011 Ito et al.
2011/0250085 A1 10/2011 Stover et al.
2011/0293456 A1 12/2011 Seibel et al.
2012/0009076 A1 1/2012 Kim et al.
2012/0067070 A1 3/2012 Albertson
2012/0107163 A1 5/2012 Monnier et al.
2012/0183422 A1 7/2012 Bahmata
2012/0195781 A1 8/2012 Stover et al.
2013/0078128 A1 3/2013 Akei
2013/0089448 A1 4/2013 Ginies et al.
2013/0094987 A1 4/2013 Yamashita et al.
2013/0098071 A1 4/2013 Means
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0275898 A1 10/2015 Ahire et al.
2015/0300353 A1 10/2015 Utpat et al.
2015/0330386 A1 11/2015 Doepker
2015/0345493 A1* 12/2015 Lochner ..... F04C 29/128
418/55.5
2015/0354719 A1 12/2015 van Beek et al.
2016/0025093 A1 1/2016 Doepker
2016/0025094 A1 1/2016 Ignatiev et al.
2016/0032924 A1 2/2016 Stover
2016/0047380 A1 2/2016 Kim et al.
2016/0053755 A1 2/2016 Taguchi
2016/0053759 A1 2/2016 Choi et al.
2016/0076543 A1 3/2016 Akei et al.
2016/0115954 A1 4/2016 Doepker et al.
2016/0138732 A1 5/2016 Lively et al.
2016/0138879 A1 5/2016 Matsukado et al.
2016/0201673 A1 7/2016 Perevozchikov et al.
2016/0208803 A1 7/2016 Uekawa et al.
2016/0272047 A1 9/2016 Gan
2017/0002817 A1 1/2017 Stover
2017/0002818 A1 1/2017 Stover
2017/0030354 A1 2/2017 Stover
2017/0097108 A1 4/2017 Huff
2017/0241417 A1 8/2017 Jin et al.
2017/0268510 A1 9/2017 Stover et al.
2017/0306960 A1 10/2017 Pax et al.
2017/0314558 A1 11/2017 Pax et al.
2017/0342978 A1 11/2017 Doepker
2017/0342983 A1 11/2017 Jin et al.
2017/0342984 A1 11/2017 Jin et al.
2018/0023570 A1 1/2018 Huang et al.
2018/0038369 A1 2/2018 Doepker et al.
2018/0038370 A1 2/2018 Doepker et al.
2018/0066656 A1 3/2018 Perevozchikov et al.
2018/0066657 A1 3/2018 Perevozchikov et al.
2018/0135625 A1 5/2018 Naganuma et al.
2018/0149155 A1 5/2018 Akei et al.
2018/0216618 A1 8/2018 Jeong
2018/0223823 A1 8/2018 Ignatiev et al.
2019/0040861 A1 2/2019 Doepker et al.
2019/0041107 A1 2/2019 Piscopo et al.
2019/0101120 A1 4/2019 Perevozchikov et al.
2019/0162185 A1 5/2019 Mizushima et al.
2019/0186491 A1 6/2019 Perevozchikov et al.
2019/0203709 A1 7/2019 Her et al.
2019/0277288 A1 9/2019 Flanigan et al.
2019/0353164 A1* 11/2019 Berning ..... F04C 18/0253
2020/0057458 A1 2/2020 Taguchi
2020/0291943 A1 9/2020 McBean et al.
2020/0370808 A1 11/2020 Feng et al.
2021/0262470 A1 8/2021 Wei et al.
2022/0065504 A1 3/2022 Zou
2022/0235774 A1 7/2022 Cui et al.

FOREIGN PATENT DOCUMENTS

CN 1158944 A 9/1997
CN 1158945 A 9/1997
CN 1177681 A 4/1998
CN 1177683 A 4/1998
CN 1259625 A 7/2000
CN 1286358 A 3/2001
CN 1289011 A 3/2001
CN 1339087 A 3/2002
CN 1349053 A 5/2002
CN 1382912 A 12/2002
CN 1407233 A 4/2003

(56) References Cited

FOREIGN PATENT DOCUMENTS

| | | | |
|---|---|---|---|
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1 241 417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 10-2001-0009403 | A | 2/2001 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130011864 | A | 1/2013 |
| KR | 20130094646 | A | 8/2013 |
| KR | 20140114212 | A | 9/2014 |
| KR | 10-2018-0094219 | A | 8/2018 |
| KR | 101917697 | B1 | 11/2018 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | 2019165254 | A1 | 8/2019 |
| WO | 2019222535 | A1 | 11/2019 |

OTHER PUBLICATIONS

Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.

Non-Final Office Action for U.S. Appl. No. 18/835,048 dated Nov. 24, 2023.

Office Action regarding U.S. Appl. No. 15/156,400, dated Feb. 23, 2017.

Office Action regarding U.S. Appl. No. 14/294,458, dated Feb. 28, 2017.

Advisory Action regarding U.S. Appl. No. 14/060,102, dated Mar. 3, 2017.

Office Action regarding U.S. Appl. No. 14/663,073, dated Apr. 11, 2017.

Office Action regarding Chinese Patent Application No. 201410460792.0, dated Apr. 24, 2017. Translation provided by Unitalen Attorneys at Law.

(56) References Cited

OTHER PUBLICATIONS

Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding U.S. Appl. No. 11/522,250, dated Aug. 1, 2007.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
Notice of Allowance regarding U.S. Appl. No. 15/692,844, dated Feb. 20, 2020.
Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by Ks Koryo International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.

(56) References Cited

OTHER PUBLICATIONS

Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action mailed Jan. 19, 2023, in U.S. App. No. 17/196,119.
Office Action mailed Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
International Search Report and Written Opinion in corresponding Application No. PCT/US2022/033029 dated Dec. 6, 2022.
Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Crompressors" (1994). International Compressor Engineering Conference. Paper 1056.
Toyama, T.; Nishikawa, Y.; Yoshida, Y.; Hiodoshi, S.; and Shibamoto, Y., "Reduction Of Noise And Over-Compression Loss By Scroll Compressor With Modified Discharge Check Valve" (2002). International Compressor Engineering Conference. Paper 1587.
Office Action regarding Chinese Patent Application No. 201010224582.3, dated Apr. 17, 2012. Translation provided by Unitalen Attorneys at Law.
Office Action regarding Indian Patent Application No. 1071/KOL/2007, dated Apr. 27, 2012.
Office Action regarding U.S. Appl. No. 13/036,529, dated Aug. 22, 2012.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding U.S. Appl. No. 14/809,786, dated Jan. 11, 2018.
Office Action regarding Chinese Patent Application No. 201580041209.5, dated Jan. 17, 2018. Translation provided by Unitalen Attorneys at Law.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by KS Koryo International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Patent Application No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.

(56) References Cited

OTHER PUBLICATIONS

Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.
Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Non-Final Office Action for U.S. Appl. No. 18/115,355 dated Jul. 18, 2023.
International Search Report Regarding Application PCT/US2023/015116-WO-POA Dated Sep. 5, 2023.
International Search Report regarding International Application No. PCT/US2011/025921, dated Oct. 7, 2011.
Written Opinion of the International Search Authority regarding International Application No. PCT/US2011/025921, dated Oct. 7, 2011.
Written Opinion of the International Searching Authority regarding International Application No. PCT/US2010/030248, dated Nov. 26, 2010.
International Search Report regarding International Application No. PCT/US2010/030248, dated Nov. 26, 2010.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding U.S. Appl. No. 11/645,288, dated Nov. 30, 2009.
Search Report regarding European Patent Application No. 07254962.9, dated Mar. 12, 2008.
Office Action regarding Chinese Patent Application No. 200710160038.5, dated Jul. 8, 2010. Translation provided by Unitalen Attorneys At Law.
Office Action regarding Chinese Patent Application No. 200710160038.5, dated Jan. 31, 2012. Translation provided by Unitalen Attorneys At Law.
Office Action regarding Chinese Patent Application No. 201080020243.1, dated Nov. 5, 2013. Translation provided by Unitalen Attorneys At Law.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Notice of Allowance regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.

(56) References Cited

OTHER PUBLICATIONS

Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Non-Final Office Action regarding U.S. Appl. No. 18/394,474 dated Apr. 11, 2024.
International Search Report and Written Opinion regarding Application No. PCT/US2023/086010 dated Apr. 24, 2024.
Final Office Action regarding U.S. Appl. No. 17/835,048 dated May 3, 2024.
Non-Final Office Action regarding U.S. Appl. No. 18/381,884 dated May 10, 2024.

* cited by examiner

COMPRESSOR AND VALVE ASSEMBLY

FIELD

The present disclosure relates to a compressor and to a valve assembly of the compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand. Sometimes the compressor may be noisy during operation. It is advantageous for an efficient compressor to have reduced sound during operation.

SUMMARY

This section provides a general summary of the disclosure and is not a comprehensive disclosure of its full scope or all of its features.

In one form, the present disclosure provides a compressor that includes a scroll and a discharge valve assembly. The scroll includes an end plate and a spiral wrap extending from the end plate. The end plate includes a discharge passage. The discharge valve assembly is mounted to the scroll and is configured to control fluid flow through the discharge passage. The discharge valve assembly includes a backer, a valve member, and a retainer body. The retainer body includes a top wall, an outer wall, and an inner hub. The outer wall is spaced apart from and surrounds the inner hub defining an annular inner passage therebetween in fluid communication with the discharge passage. The backer is disposed between the valve member and the retainer body. The backer defines a range of motion of the valve member. The valve member is deflectable between a closed position in which the valve member restricts fluid flow through the discharge passage and an open position in which the valve member allows fluid flow through the discharge passage.

In some configurations of the compressor of the above paragraph, the valve member is a reed valve having a fixed end and a movable end that deflects relative to the fixed end between the open and closed positions.

In some configurations of the compressor of either of the above paragraphs, the first portion of the discharge valve assembly includes a base fixed relative to the end plate. The valve member is mounted to the base. The valve member is disposed between the base and the backer.

In some configurations of the compressor of any of the above paragraphs, the first portion of the discharge valve assembly further includes a spacer disposed between the base and the valve member.

In some configurations of the compressor of any of the above paragraphs, a first side of the base includes a seat surface. A movable end of the valve member contacts the seat surface when the valve member is in the closed position.

The movable end of the valve member is spaced apart from the seat surface when the valve member is in the open position.

In some configurations of the compressor of any of the above paragraphs, an axial end of the retainer body engages a surface of the backer.

In some configurations of the compressor of any of the above paragraphs, the retainer body, the backer, and the valve member are disposed within a recess of the scroll.

In some configurations of the compressor of any of the above paragraphs, when the valve member is in the open position, working fluid flows through the discharge passage and through the retainer body before flowing through an aperture in a partition that separates a suction chamber of the compressor from a discharge chamber of the compressor.

In some configurations of the compressor of any of the above paragraphs, the top wall defines one or more apertures in fluid communication with the inner passage.

In some configurations of the compressor of any of the above paragraphs, the one or more apertures are slots.

In some configurations of the compressor of any of the above paragraphs, each of the slots include a first end and a second end. The slots are curved between the first and second ends.

In some configurations of the compressor of any of the above paragraphs, the one or more apertures are kidney-shaped apertures.

In some configurations of the compressor of any of the above paragraphs, the compressor further includes a shell assembly defining a suction chamber and a discharge chamber. When the valve member is in the open position, working fluid flows through the discharge passage and through the inner passage of the retainer body to the discharge chamber.

In some configurations of the compressor of any of the above paragraphs, the top wall of the retainer body defines one or more apertures in fluid communication with the inner passage and the discharge chamber. When the valve member is in the open position, the one or more apertures allow fluid communication between the discharge passage and the discharge chamber.

In some configurations of the compressor of any of the above paragraphs, the scroll is a non-orbiting scroll.

In another form, the present disclosure provides a compressor that includes a shell assembly, a scroll, and a discharge valve assembly. The scroll is disposed within the shell assembly. The scroll includes a first end plate and a first spiral wrap. The first end plate includes a discharge passage and a discharge recess in fluid communication with the discharge chamber. The discharge valve assembly is mounted to the scroll. The discharge valve assembly is configured to control fluid flow between the discharge passage and the discharge chamber. The discharge valve assembly includes a valve member, a backer, and a retainer body. The discharge valve assembly defines a first passage, a second passage, and a third passage. The backer is disposed between the valve member and the retainer body. The backer defines the first passage. The first passage is in fluid communication with the discharge passage. The second passage is an annular passage defined by the retainer body. The second passage is in fluid communication with the first passage and the third passage. The third passage includes one or more apertures formed in the retainer body. The second passage is disposed between the first and third passages such that when the valve member is in an open position, fluid flows from the first passage to the second passage and subsequently through the third passage.

In some configurations of the compressor of the above paragraph, the backer defines a range of motion of the valve member. The valve member is deflectable relative to the first end plate between a closed position and the open position. When the valve member is in the closed position, the valve member restricts fluid flow through the discharge passage. When the valve member is in the open position, the valve member allows fluid flow through the discharge passage.

In some configurations of the compressor of either of the above paragraphs, the valve member is a reed valve having a fixed end and a movable end that deflects relative to the fixed end between the open and closed positions.

In some configurations of the compressor of any of the above paragraphs, the discharge valve assembly further includes a base fixed relative to the end plate. The valve member is disposed between the base and the backer. The valve member contacts a seat surface of the base when the valve member is in the closed position. The valve member is spaced apart from the seat surface of the base when the valve member is in the open position.

In some configurations of the compressor of any of the above paragraphs, the one or more apertures are slots.

In some configurations of the compressor of any of the above paragraphs, each of the slots includes a first end and a second end. The slots are curved between the first and second ends.

In some configurations of the compressor of any of the above paragraphs, the one or more apertures are kidney-shaped apertures.

In some configurations of the compressor of any of the above paragraphs, the backer includes a pair of arms and a lobe portion. The first passage is defined by the pair of arms and the lobe portion.

In some configurations of the compressor of any of the above paragraphs, an axial end of the retainer body engages a surface of the backer.

In some configurations of the compressor of any of the above paragraphs, the retainer body, the backer, and the valve member are disposed within a recess in the scroll.

In some configurations of the compressor of any of the above paragraphs, when the valve member is in the open position, working fluid flows through the discharge passage, through the first passage, through the second passage, and through the third passage before flowing through an aperture in a partition that separates the suction chamber from the discharge chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
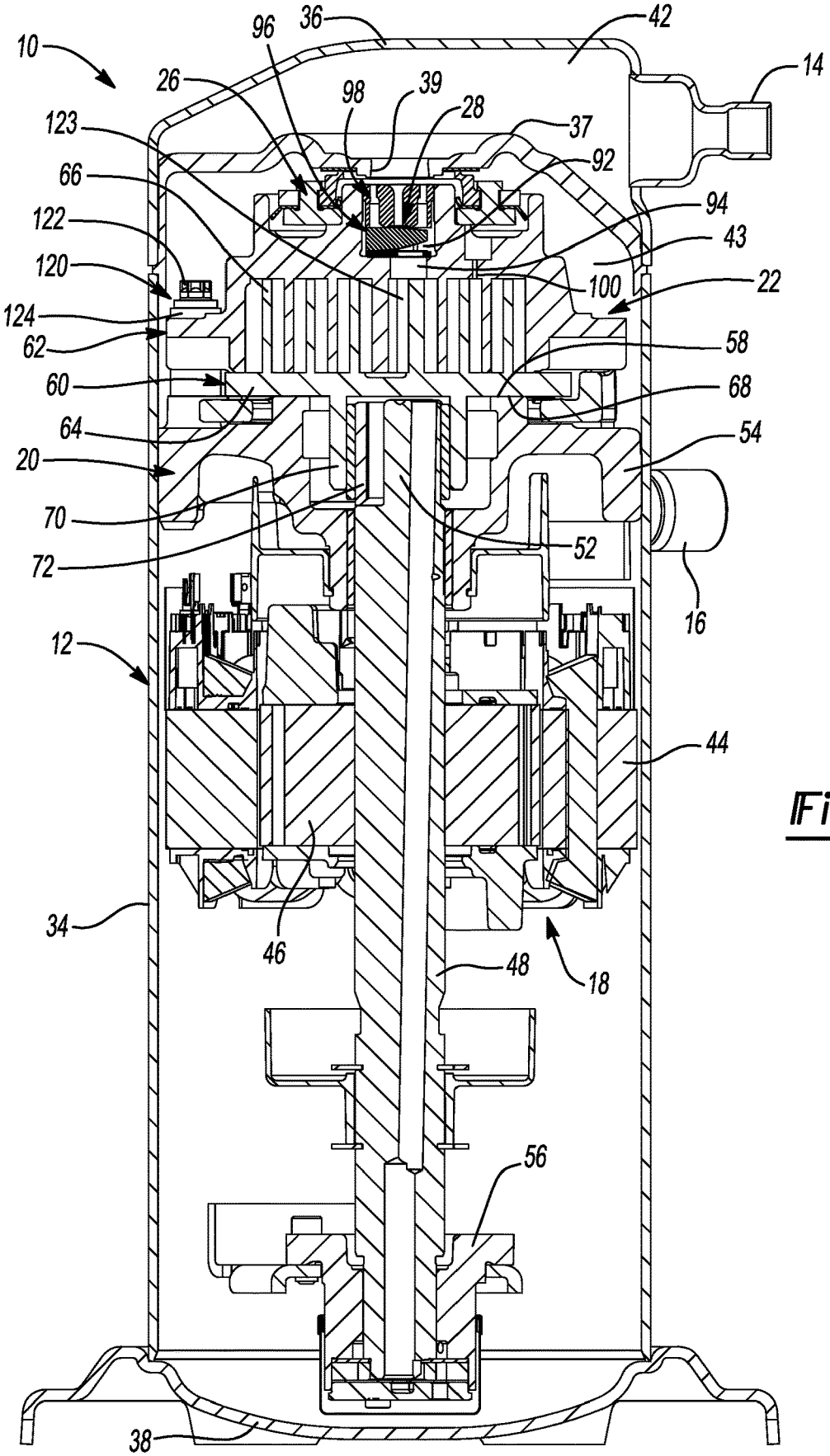
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a scroll compressor 10 is provided that may include a shell assembly 12, a discharge fitting 14, a suction inlet fitting 16, a motor assembly 18, a bearing housing assembly 20, a compression mechanism 22, a floating seal assembly 26, and a discharge valve assembly 28. As will be described in more detail below, the discharge valve assembly 28 is movable between a closed position (FIG. 2) in which the discharge valve assembly 28 restricts a flow of discharge-pressure working fluid and an open position (FIG. 3) in which the discharge valve assembly 28 allows discharge-pressure working fluid to be discharged from the compression mechanism 22.

The shell assembly 12 may house the motor assembly 18, the bearing housing assembly 20, the compression mechanism 22, the floating seal assembly 26, and the discharge valve assembly 28. The shell assembly 12 may include a generally cylindrical shell 34, an end cap 36, a transversely extending partition 37, and a base 38. The end cap 36 may be fixed to an upper end of the shell 34. The base 38 may be fixed to a lower end of the shell 34. The end cap 36 and the partition 37 may define a discharge chamber 42 therebetween that receives compressed working fluid from the compression mechanism 22. The partition 37 may include an aperture 39 providing communication between the compression mechanism 22 and the discharge chamber 42. The discharge chamber 42 may generally form a discharge muffler for the compressor 10.

The discharge fitting 14 may be attached to the end cap 36 and is in fluid communication with the discharge chamber 42. The suction inlet fitting 16 may be attached to the shell 34 and may be in fluid communication with a suction chamber 43. While the compressor 10 is shown in FIG. 1 as including the discharge chamber 42 and suction chamber 43, it will be appreciated that the present disclosure is not limited to compressors having discharge chambers and/or suction chambers and applies equally to direct discharge configurations and/or direct or directed suction configurations.

The motor assembly 18 may include a motor stator 44, a rotor 46, and a drive shaft 48. The stator 44 may be press fit into the shell 34. The drive shaft 48 may be rotatably driven by the rotor 46 and supported by the bearing housing assembly 20. The drive shaft 48 may include an eccentric crank pin 52 having a flat thereon for driving engagement with the compression mechanism 22. The rotor 46 may be press fit on the drive shaft 48. The bearing housing assembly 20 may include a main bearing housing 54 and a lower bearing housing 56 fixed within the shell 34. The bearing housings 54, 56 may be fixed relative to the shell assembly 12 and may house bearings that rotatably support the drive shaft 48. The main bearing housing 54 may include an annular flat thrust bearing surface 58 that supports the compression mechanism 22 thereon.

The compression mechanism 22 may be driven by the motor assembly 18 and may generally include an orbiting scroll 60 and a non-orbiting scroll 62. The orbiting scroll 60 may include an end plate 64 having a spiral vane or wrap 66 on the upper surface thereof and an annular flat thrust surface 68 on the lower surface. The thrust surface 68 may interface with an annular flat thrust bearing surface 58 on the main bearing housing 54. A cylindrical hub 70 may project downwardly from the thrust surface 68 and may have a drive bushing 72 disposed therein. The drive bushing 72 may include an inner bore in which the crank pin 52 is drivingly disposed. The crank pin 52 may drivingly engage a flat surface in a portion of the inner bore of the drive bushing 72 to provide a radially compliant driving arrangement.

Figure 2:
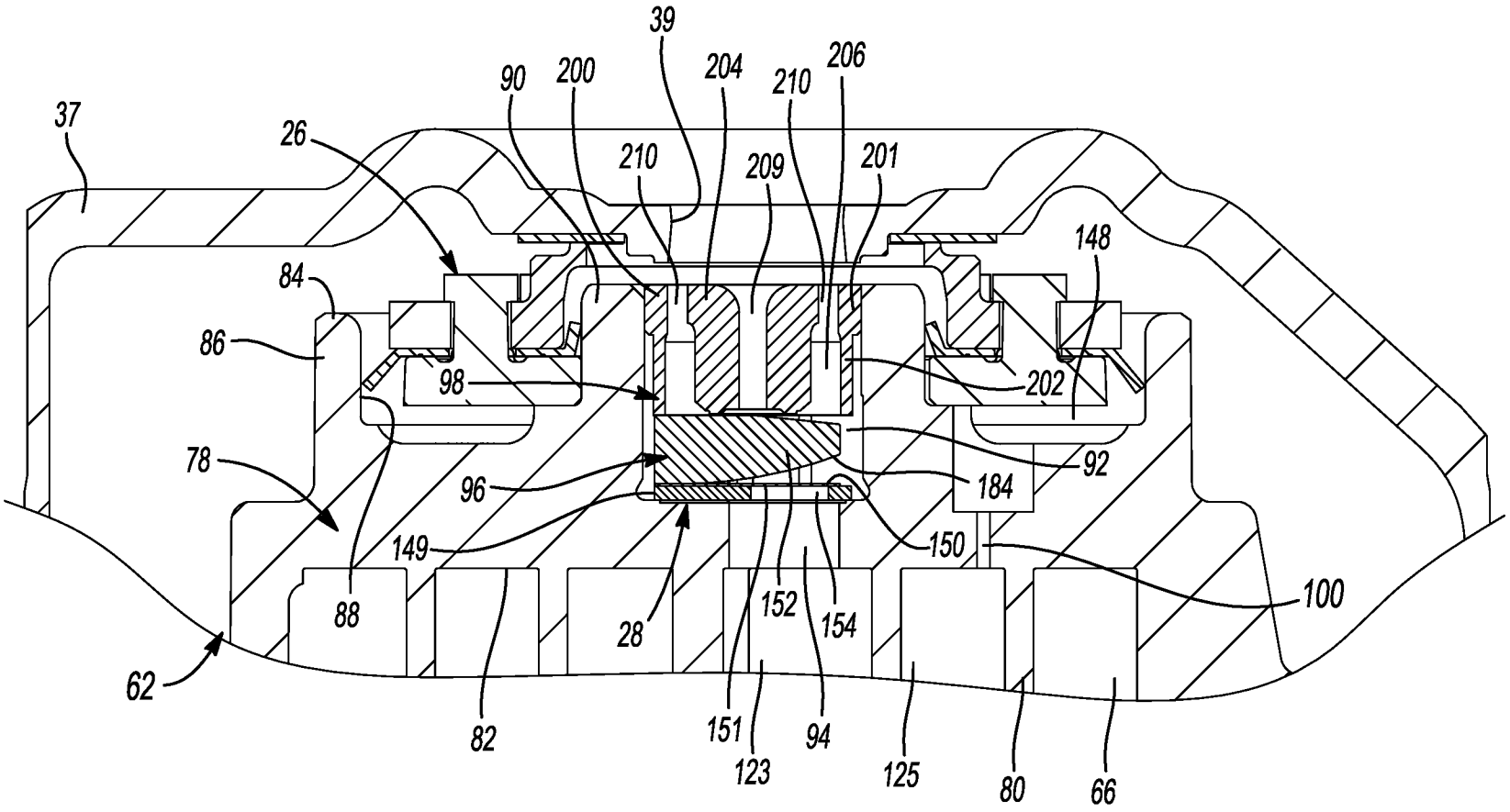
FIG. 2 is a partial cross-sectional view of a compression mechanism of the compressor of FIG. 1 with a discharge valve assembly in a closed position.
Figure 3:
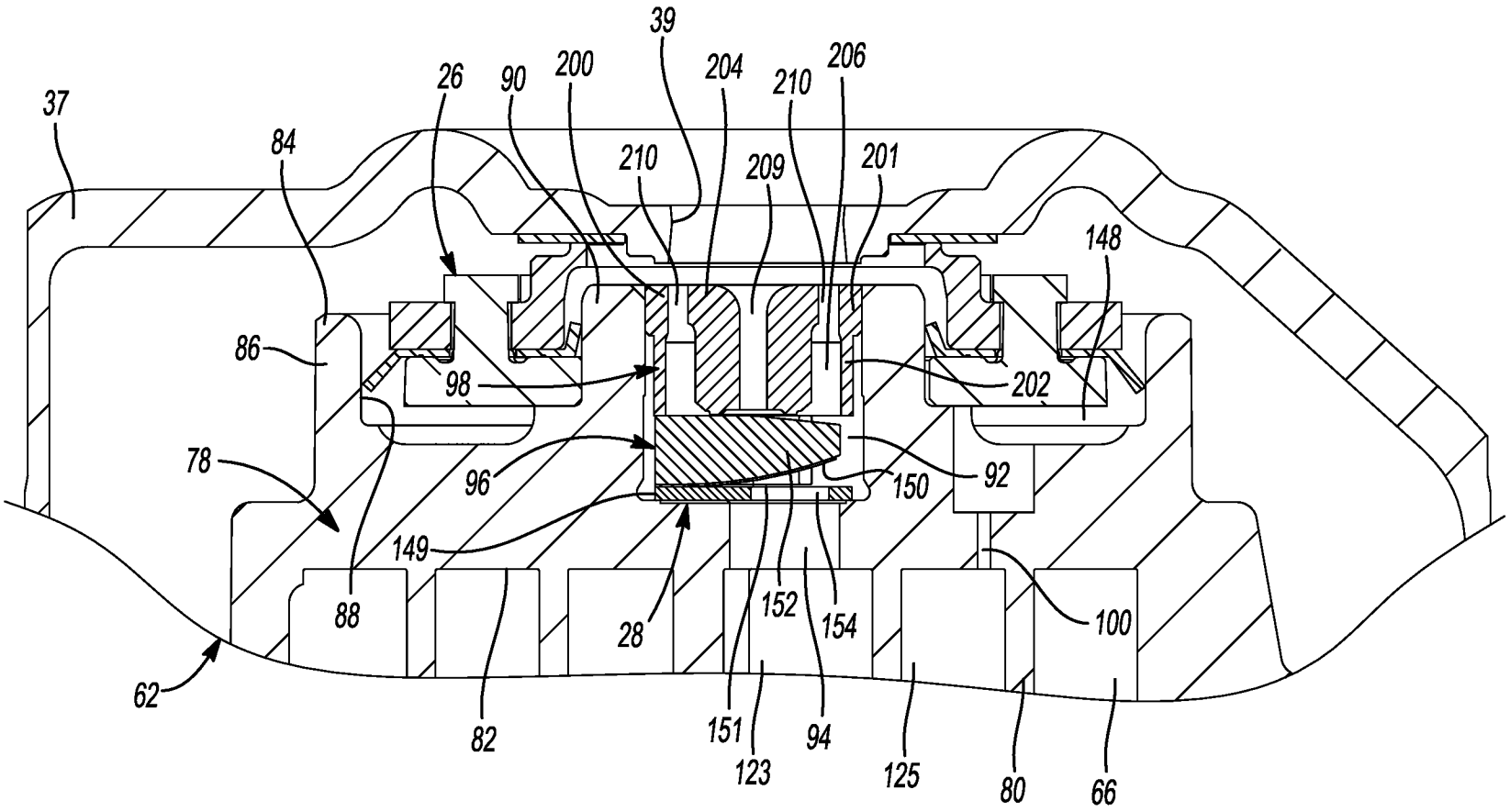
FIG. 3 is another partial cross-sectional view of the compression mechanism of FIG. 2 with the discharge valve assembly in an open position.
Figure 4:
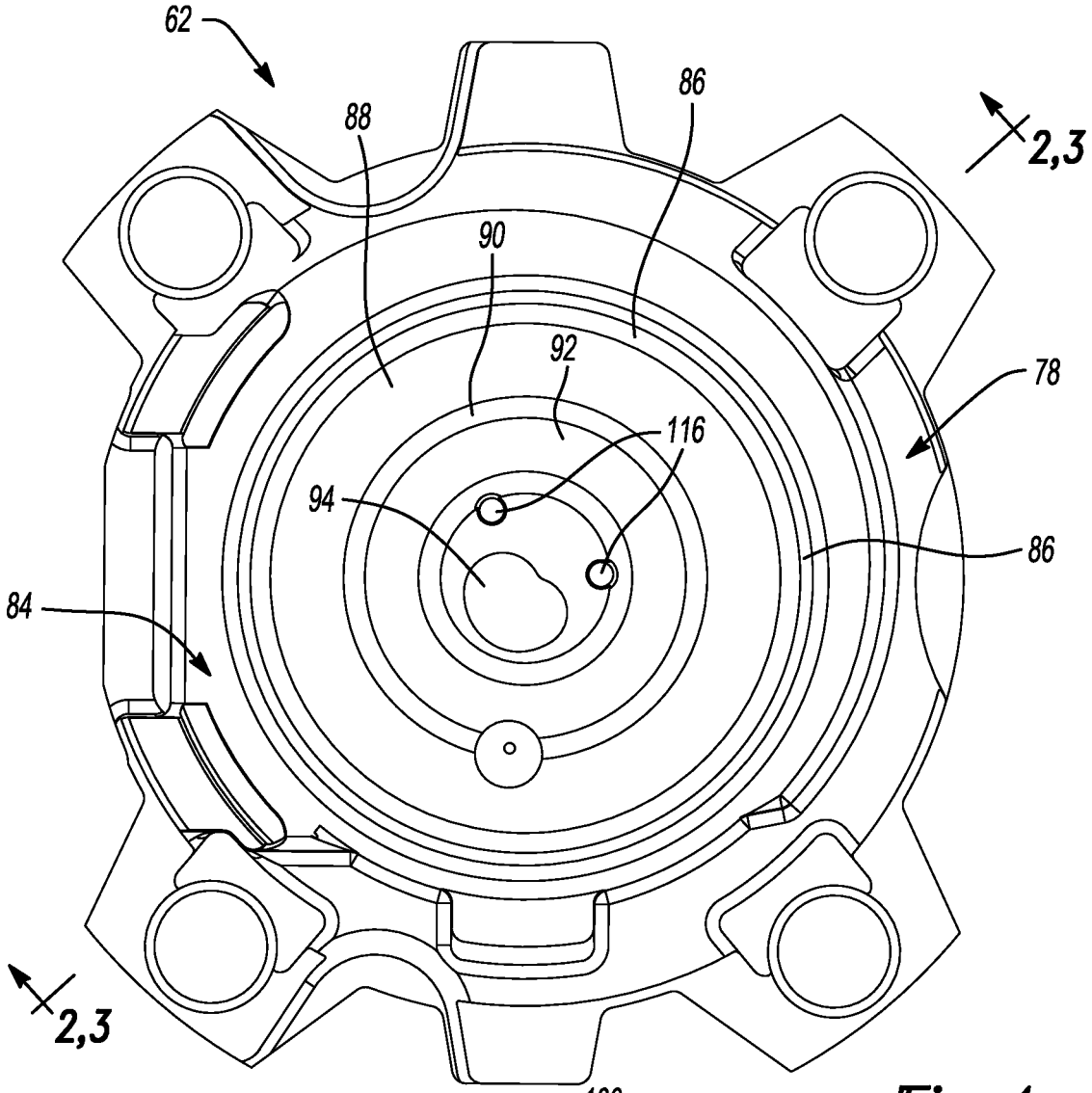
FIG. 4 is a plan view of a non-orbiting scroll of the compressor of FIG. 1.

As shown in FIGS. 2-4, the non-orbiting scroll 62 may include an end plate 78 and a spiral wrap 80 extending from a first side 82 of the end plate 78. A second side 84 of the end plate 78 may include a first annular wall 86 and a second annular wall 90. The first and second annular walls 86, 90 cooperate to define an annular recess 88. The second annular wall 90 may be disposed radially inward relative to the first annular wall 86 and may define a discharge recess 92. The annular recess 88 may encircle the discharge recess 92 and may be substantially concentric therewith. As shown in FIGS. 2 and 3, a discharge passage 94 may extend through the end plate 78 from the first side 82 to the discharge recess 92.

As shown in FIG. 4, the end plate 78 may include a pair of bores 116. In some embodiments, the bores 116 may be blind, non-threaded holes formed in the discharge recess 92 that extend only partially through the end plate 78. In some embodiments, the bores 116 may be threaded holes formed in the discharge recess 92 that extend only partially through the end plate 78.

Returning to FIG. 1, the non-orbiting scroll 62 may be rotationally secured to the main bearing housing 54 by a retaining assembly 120. The retaining assembly 120 allows for limited axial displacement of the non-orbiting scroll 62 relative to the orbiting scroll 60 and the main bearing housing 54 based on pressurized gas from a biasing passage 100. The retaining assembly 120 may include a plurality of fasteners 122 and bushings 124 extending through apertures in the non-orbiting scroll 62. The fasteners 122 may fixedly engage the main bearing housing 54. The non-orbiting scroll 62 may be axially moveable along the bushings 124 relative to the fasteners 122.

The spiral wrap 80 of the non-orbiting scroll 62 may meshingly engage the spiral wrap 66 of the orbiting scroll 60, thereby creating a series of pockets therebetween. The fluid pockets defined by the spiral wraps 66, 80 may decrease in volume as they move from a radially outer position (at a suction pressure) to a radially intermediate position (at an intermediate pressure) to a radially inner position (at a discharge pressure) throughout a compression cycle of the compression mechanism 22. The discharge passage 94 may be in fluid communication with a fluid pocket 123 at the radially inner position. When the discharge valve assembly 28 is in the open position (FIG. 2), working fluid from the fluid pocket 123 at the radially inner position (discharge-pressure working fluid) may flow through the discharge passage 94, through the discharge valve assembly 28, through the discharge recess 92 and into the discharge chamber 42. The biasing passage 100 in the end plate 78 may be in fluid communication with a fluid pocket 125 (FIGS. 2 and 3) at the radially intermediate position.

With renewed reference to FIGS. 2 and 3, the floating seal assembly 26 may be disposed within the annular recess 88 and may sealingly engage the first annular wall 86, second annular wall 90, and the partition 37 to form an annular biasing chamber 148. The annular biasing chamber 148 is isolated from the suction and discharge chambers 43, 42 and is in communication with the fluid pocket 125 at the radially intermediate position via the biasing passage 100. During operation of the compressor 10, the biasing chamber 148 may be filled with intermediate-pressure working fluid from the fluid pocket 125 at the radially intermediate position, which biases the non-orbiting scroll 62 in an axial direction toward the orbiting scroll 60.

The discharge valve assembly 28 may be received in the discharge recess 92 of the non-orbiting scroll 62 and may control fluid flow through the discharge passage 94. As shown in FIGS. 5-10, the discharge valve assembly 28 may include a first portion or valve member portion 96 and a second portion or retainer portion 98.

Figure 5:
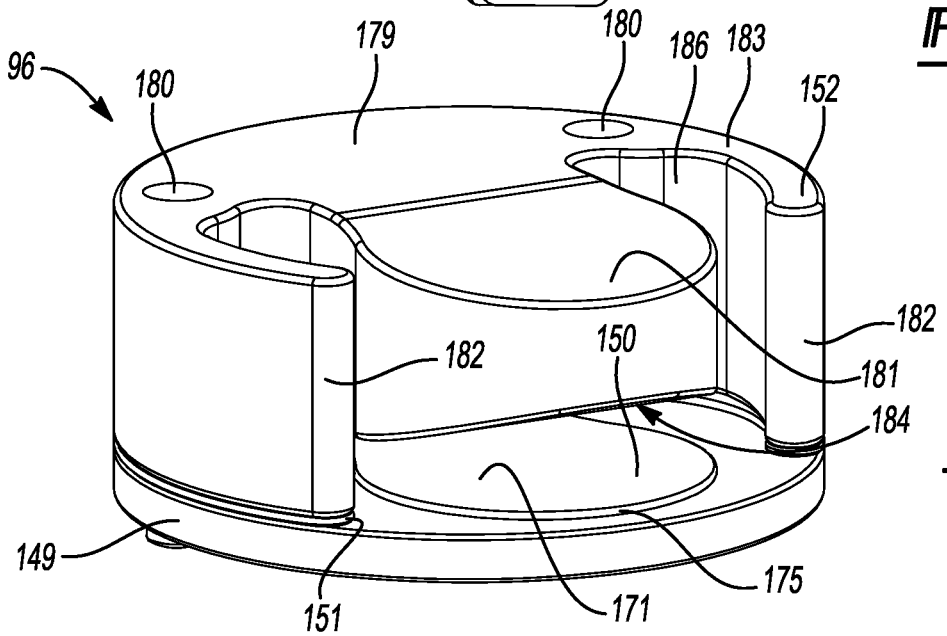
FIG. 5 is perspective view of a first portion the discharge valve assembly according to the principles of the present disclosure.
Figure 6:
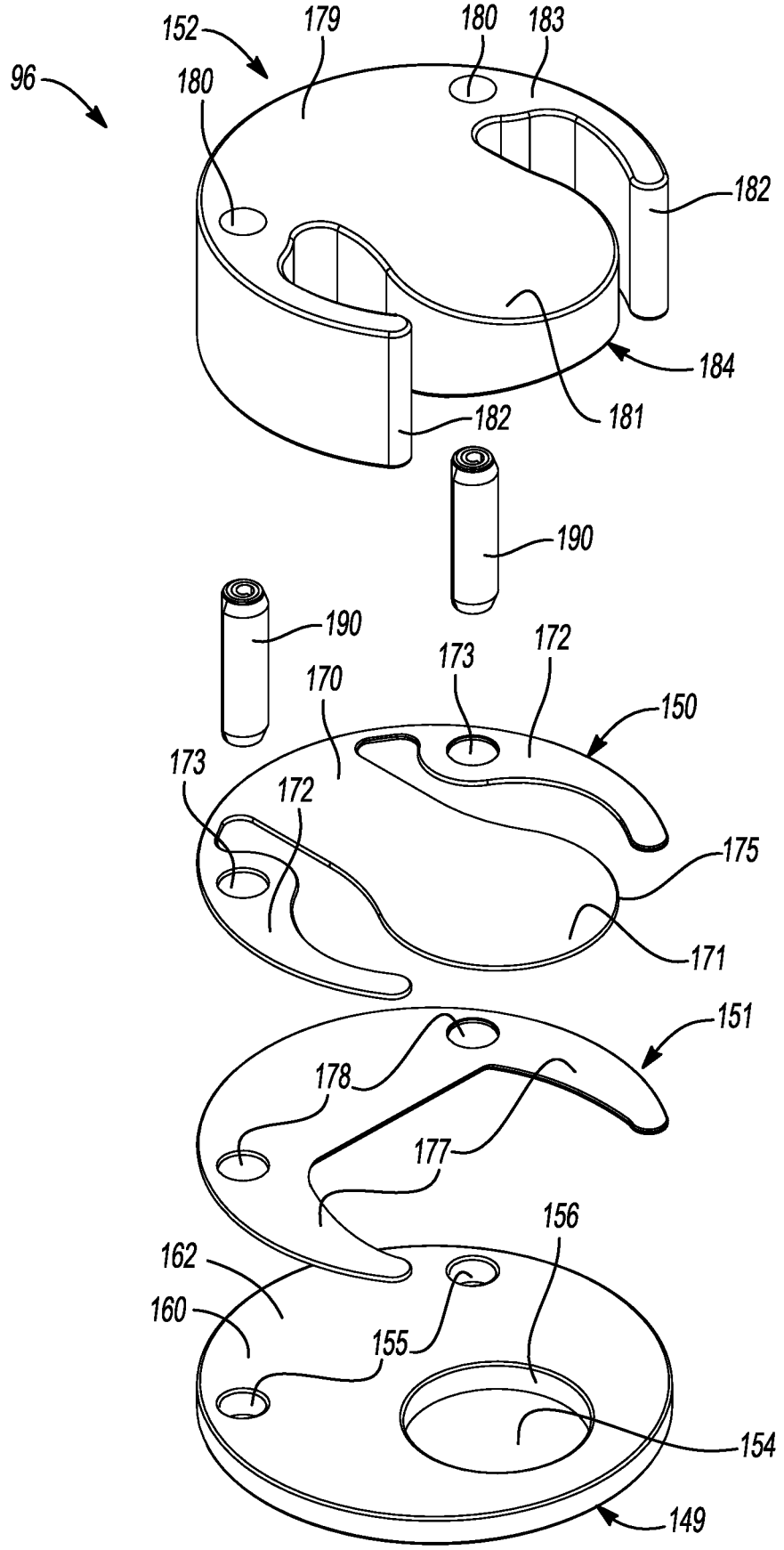
FIG. 6 is an exploded view of the first portion the discharge valve assembly of FIG. 5.

With reference to FIGS. 5 and 6, the valve member portion 96 may include a base 149, a reed valve member 150, a spacer 151, and a backer 152. The base 149 may be a disk-shaped member having a discharge opening 154 and a pair of bores 155 extending therethrough. The bores 155 may be coaxially aligned with the bores 116 of the end plate 78. The base 149 may be seated against the end plate 78 such that the discharge opening 154 is generally aligned with the discharge passage 94, as shown in FIGS. 2 and 3. A surface 156 defines a periphery of the discharge opening 154. In the configuration of FIGS. 5 and 6, the discharge opening 154 has a generally circular shape, although other configurations are possible.

The base 149 may include a seat surface 160 on a first side 162 of the base 149. The spacer 151 may be mounted to the seat surface 160. The first side 162 of the base 149 may be the side adjacent to the reed valve member 150 when the discharge valve assembly 28 is assembled.

The reed valve member 150 may be a thin, resiliently flexible member having a fixed end 170 and a movable end 171. A pair of arms 172 may extend from the fixed end 170 and may each include a bore 173. The reed valve member 150 may be seated against the spacer 151, which in turn, may be seated against the base 149 such that the bores 173 are coaxially aligned with the bores 155 in the base 149. The movable end 171 of the reed valve member 150 is deflectable relative to the fixed end 170 between the closed position (FIG. 2) in which the movable end 171 sealingly seats against the base 149 to restrict or prevent fluid flow through the discharge opening 154 (thereby preventing fluid flow through the discharge passage 94) and the open position (FIG. 3) in which the movable end 171 is deflected upward away from the base 149 and toward the backer 152 to allow fluid flow through the discharge passage 94 and the discharge opening 154.

The reed valve member 150 may be moved to the open position due to a pressure differential on opposing sides of the reed valve member 150, such as when the pressure within the discharge passage 94 (and fluid pocket 123) exceeds the pressure within the discharge chamber 42. An amount of deflection of the movable end 171 of the reed valve member 150 may vary based on a distance from the fixed end 170. For example, the amount of deflection may be larger in portions of the movable end 171 of the reed valve member 150 which are farther away from the fixed end 170. The fixed end 170 may be fixed by the backer 152 being coupled to the base 149 (i.e., the fixed end 170 is sandwiched between the backer 152 and the base 149). A maximum amount of deflection of the movable end 171 may occur at a portion 175 of the movable end 171 of the reed valve member 150 furthest from the fixed end 170.

The movable end 171 of the reed valve member 150 may move to the closed position by moving in a downward direction toward the seat surface 160 due to the pressure in the discharge chamber 42 increasing relative to the pressure within the discharge passage 94 and/or due to pressure within the discharge passage 94 decreasing relative to the pressure in the discharge chamber 42, which allows the spring force of the resiliently flexible reed valve member 150 to force the movable end 171 toward the closed position. In the closed position, the reed valve member 150 restricts or prevents fluid flow between the discharge chamber 42 and the discharge passage 94.

The spacer 151 may include a pair of arms 177 shaped to correspond to the arms 172 of the reed valve member 150. Each of the arms 177 may include a bore 178 coaxially aligned with corresponding ones of the bores 173, 155. The spacer 151 may be disposed between the base 149 and the reed valve member 150 to create a space between the movable end 171 and the discharge opening 154. The movable end 171 of the reed valve member 151 may move into this space when entering the closed position to seal the discharge opening 154.

The backer 152 may include a body 179 having a pair of bores 180 extending therethrough. The bores 180 may be coaxially aligned with corresponding bores 173, 155, 178. The body 179 may include a lobe portion 181 shaped to correspond to the shape of the movable end 171 of the reed valve member 150. The body may include a pair of arms 182 shaped to correspond to the arms 177 of the spacer and/or 172 of the reed valve member 150. The body 179 may include a first or top surface 183. The lobe portion 181 may include an inclined surface 184 that faces the reed valve member 150 and forms a valve stop that defines a maximum amount of deflection of the movable end 171 of the reed valve member 150. The inclined surface 184 may be shaped to allow the reed valve member 150 to open to a greater extent than traditional discharge valve assemblies while limiting stress in the reed valve member 150. Such an expanded opening may allow for increased flow of the working fluid through the discharge passage 94 and through the discharge valve assembly 28. Such increased fluid flow improves the efficiency of the compressor 10, which reduces energy consumption and improves operation of the climate-control system in which the compressor 10 is installed.

When the reed valve member 150 is in the open position (FIG. 2), a first passage or recess passage 186 may be defined by the seat surface 160 of the base 149, the arms 177 of the spacer 151, the arms 182 of the backer 152, and the lobe portion 181 of the backer 152. The recess passage 186 is disposed within the discharge recess 92. As will be described in greater detail below, the recess passage 186 may be in fluid communication with the discharge passage 94 and the discharge chamber 42 when the reed valve member 150 is in the open position.

Fasteners 190 may pass through the bores 116, 155, 173, 178, 180 to secure the discharge valve assembly 28 to the end plate 78. In some embodiments, the fasteners may be threaded. In some embodiments, the fasteners may be spiral pins having resiliently contractable diameters to facilitate insertion into the bores 116, 155, 173, 178, 180. In some embodiments, pins may be press fit in the non-threaded bores 116, 155, 173, 178, 180 to secure the discharge valve assembly 28 to the end plate 78.

Figure 7:
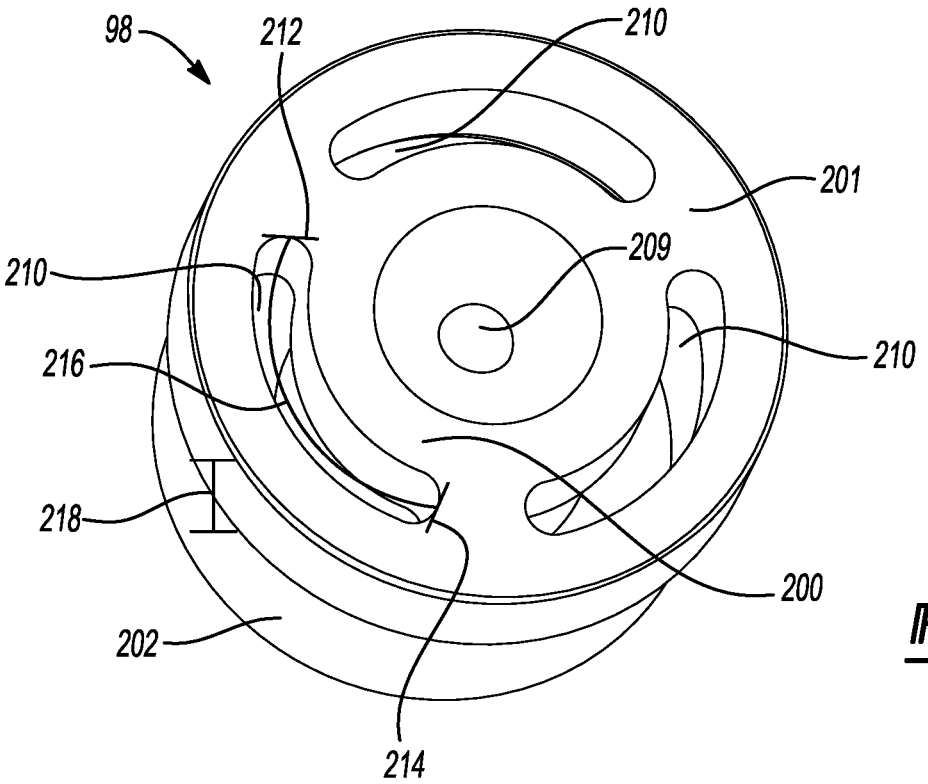
FIG. 7 is a perspective view of a second portion of the discharge valve assembly according to the principles of the present disclosure.
Figure 8:
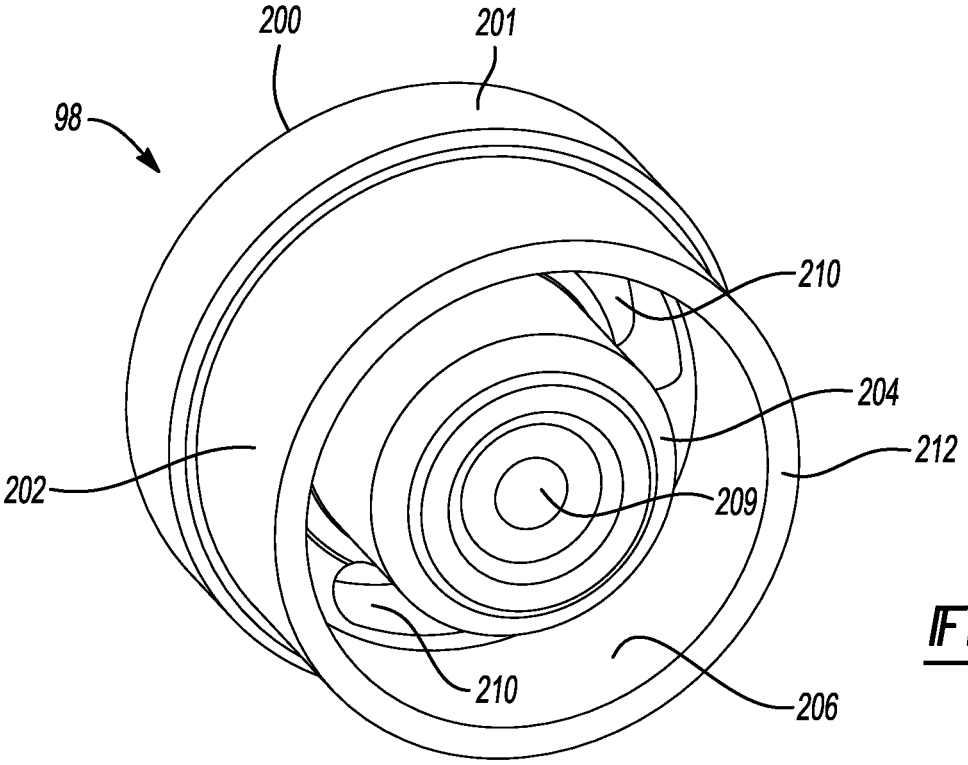
FIG. 8 is another perspective view of the second portion of the discharge valve assembly.

As shown in FIGS. 7 and 8, the retainer portion 98 of the discharge valve assembly 28 may include a retainer body 200. The retainer body 200 may be an annular member including a first or top wall 201, an outer wall 202 and an inner hub 204. The outer wall 202 and the inner hub 204 may extend generally perpendicularly from the top wall 201 in a first direction. The top wall 201 may be integrally formed with the outer wall 202 and/or the inner hub 204. The outer wall 202 may be spaced apart from and surround the inner hub 204 to define a second passage or inner passage 206. The inner passage 206 may be an annular passage. In other words, the inner passage 206 may surround the inner hub 204.

The inner hub 204 may cooperate with the top wall 201 to define a central aperture or passage 209 extending therethrough. The central aperture 209 may by fluidly connected to the inner passage 206. The inner hub 204 may be generally cylindrical or cup-shaped, although other shapes and configurations are possible. While a central aperture 209 is shown in the embodiment of FIGS. 7-10, it can be appreciated that alternate embodiments may include an inner hub that is free of a central aperture (i.e., an inner hub that does not define an opening extending therethrough).

The top wall may define a third passage. The third passage may include one or more retainer apertures 210. The one or more retainer apertures 210 may extend through the top wall 201 and may be fluidly connected with the inner passage 206. During normal operation of the compressor 10, fluid may flow from the discharge passage 94, through the recess passage 186 (FIGS. 5 and 9-10), through the inner passage 206, through the central aperture 209 and/or retainer apertures 210, and into the discharge chamber 42. In some configurations, such as when the inner hub 204 is free of a central aperture, during operation of the compressor 10, fluid may flow from the discharge passage 94, through the recess passage 186, through the inner passage 206, through the retainer apertures 210 and into the discharge chamber 42.

Each of the retainer apertures 210 may be elongated between a first end 212 and a second end 214. For example, the retainer apertures 210 may be slots. Each of the slots may be curved between the first end 212 and the second end 214. The retainer apertures 210 may curve along at least a portion of the perimeter of the top wall 201. In the configuration shown in FIGS. 7-10, the retainer apertures 210 are generally kidney shaped, although other shapes and configurations are possible to control fluid flow through the retainer apertures 210. The retainer apertures 210 may have a volume defined by a length 216 of the aperture 210 (e.g., a length between the first end 212 and the second end 214), a width of the aperture, and a thickness 218 of the top wall 201. The volume of the aperture 210 may be tailored by modifying the length 216, width or shape of the aperture 210, and/or the thickness 218 of the top wall 201. The volume, shape, and quantity of the apertures 210 may be tailored to meet the desired fluid flow and acoustic characteristics of the compressor 10.

The first end 212 and the second end 214 may have a round shape. Retainer apertures 210 having rounded first and second ends 212, 214 may decrease the operational noise and/or sound of the compressor 10 as compared to a compressor with retainer apertures having flat or sharp edges.

While three evenly-spaced retainer apertures 210 are shown in the embodiment of FIGS. 7-10, it can be appreciated that a retainer body 200 including more or less apertures and/or apertures having varying sizes and spacing may also be utilized. For example, a single aperture may extend around the perimeter of the top wall 201. Alternately, the top wall 201 may only include two apertures. In some configurations, the top wall 201 may include more than three apertures, such as greater than or equal to four apertures, optionally greater than or equal to five apertures, optionally greater than or equal to seven apertures, or optionally greater than or equal to ten apertures.

While not shown in the embodiment of FIGS. 7-10, it can be appreciated that in some configurations, a peripheral surface 220 (FIG. 9) of the top wall 201 may have external threads. When the retainer body 200 includes external threads, the retainer body 200 may threadably engage a portion of the compressor mechanism 22 (FIG. 1) (e.g., a portion of the non-orbiting scroll 62).

Figure 9:
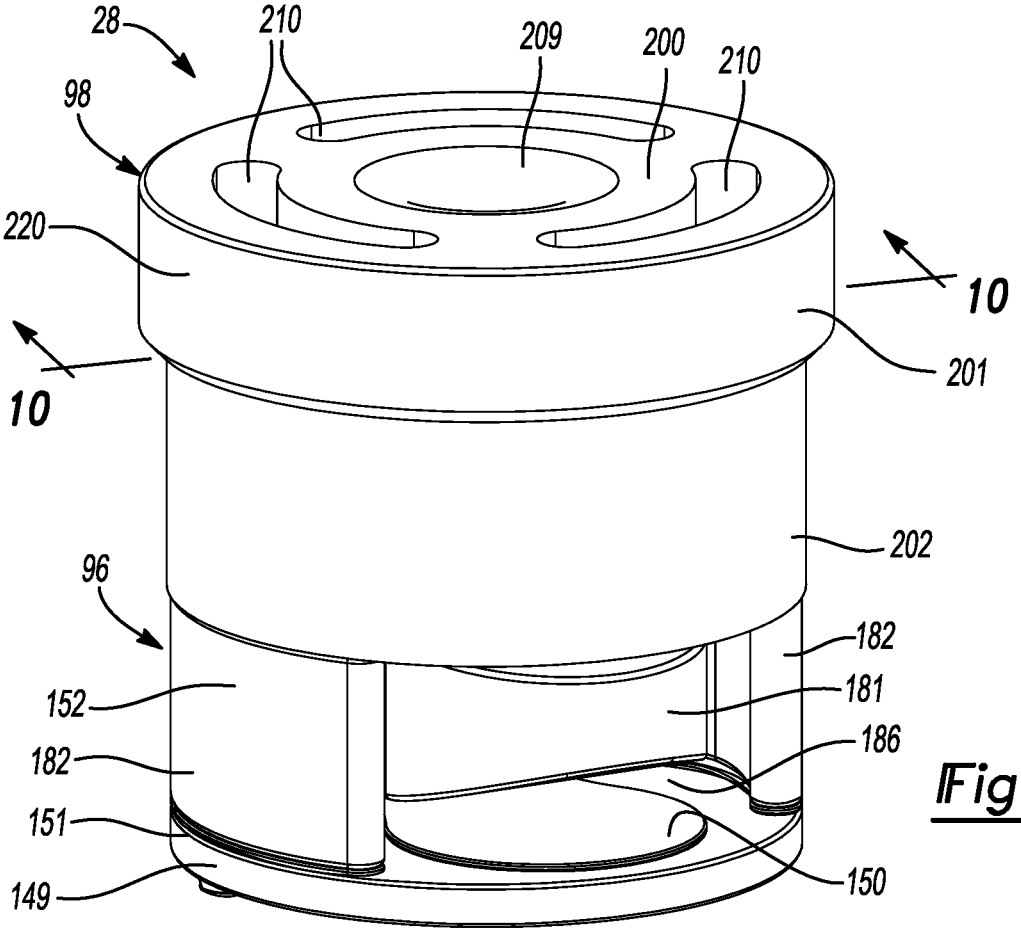
FIG. 9 is a perspective view of the discharge valve assembly including the first portion and the second portion according to the principles of the present disclosure.
Figure 10:
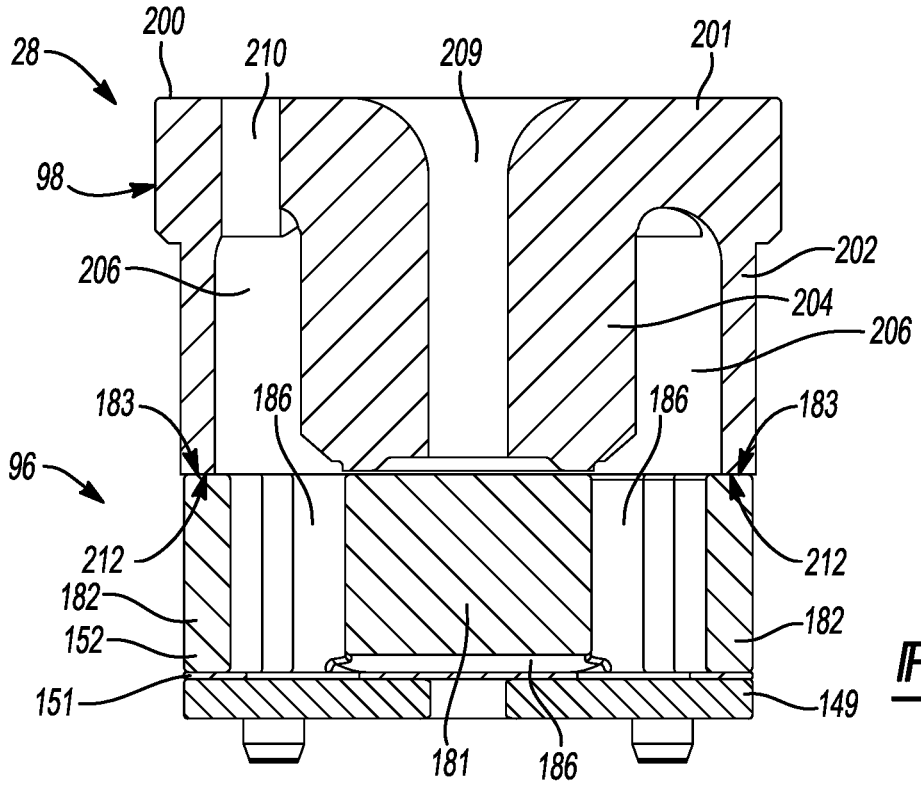
FIG. 10 is a cross-sectional view of the discharge valve assembly of FIG. 9.

As shown in FIGS. 9 and 10, the retainer portion 98 is engaged with the valve member portion 96 of the discharge valve assembly 28. The retainer portion 98 may be disposed within the discharge recess 92. The backer 152 may be disposed between the reed valve member 150 and the retainer portion 98 such that fluid flowing through the discharge opening 154 flows through the recess passage 186 of the valve member portion 96 before flowing through the retainer portion 98. At least a portion of the outer wall 202 may be engaged with the first surface 183 of the arms 182 of the backer 152. For example, a distal surface 212 of the outer wall 202 may seat against the first surface 183 of the arms 182 of the backer 152. In the configuration of FIGS. 9-10, the inner hub 204 is spaced apart from the lobe portion 181 of the backer 152. When the inner hub 204 is spaced apart from the lobe portion 181, the central aperture 209 may be in fluid communication with the discharge chamber 94, such as via the discharge opening 154 (FIGS. 2 and 3), discharge recess 92 and inner passage 206. Alternately, the inner hub 204 may be configured to contact and engage the first surface 183 of the lobe portion 181 of the backer 152. The retainer portion 98 may be engaged or otherwise attached to the valve member portion 96 via fasteners (e.g., pins and/or bolts), adhesive, and/or welds. In some configurations, the retainer portion 98 is integrally formed with the valve member portion 96.

With renewed reference to FIGS. 2 and 3, the movable end 171 of the reed valve member 150 may sit and/or seal against the seat surface 160 of the base 149 adjacent to the periphery of the discharge opening 154 when in the closed position (FIG. 2) due to the pressure differential between the discharge chamber 42 and the discharge passage 94. In this way, the movable end 171 of the reed valve member 150 may improve or reduce leakage of fluid moving from the discharge passage 94 to the discharge chamber 42. When the reed valve member 150 is in the closed position, fluid may be prevented from moving from the discharge passage 94 to the discharge chamber 42. When the movable end 171 of the reed valve member 150 is in the closed position, leakage of working fluid through the discharge valve assembly 28 may be improved or reduced, thus improving efficiency of the compressor 10, which reduces energy consumption and improves operation of the climate-control system in which the compressor 10 is installed.

The movable end 171 of the reed valve member 150 may deflect or contact the inclined surface 184 of the backer 152 when in the open position (FIG. 3) due to the pressure differential between the discharge chamber 42 and the discharge passage 94. When the movable end 171 of the reed member 150 is in the open position, working fluid from the discharge passage 94 travels through the discharge opening 154 to the discharge chamber 42. The inner passage 206 is in fluid communication with the discharge passage 94 (e.g., via the discharge opening 154 and recess passage 186) and the discharge chamber 42 (e.g., via the retainer apertures 210 and the aperture 39). That is, when the reed valve member 150 is in an open position fluid is allowed to flow from the discharge passage 94, through the discharge opening 154, through the recess passage 186, through the inner passage 206, through retainer apertures 210 (and optionally though the central aperture 209), through the aperture 39 and into the discharge chamber 42.

In some discharge valve assemblies, when the reed valve member 150 is in the open position, the fluid flow through the discharge opening 154 is partially obstructed by the lobe portion 181 of the backer 152, causing turbulent fluid vibrations (e.g., vortices) to move around the lobe portion 181 through the recess passage 186 and into the discharge chamber 42. These vibrations from the fluid flow may create acoustic wave pulses that may excite the end cap 36 and/or the partition 37. When the end cap 36 and/or the partition 37 are excited, the compressor may be relatively noisy during operation.

In the discharge valve assembly of the present disclosure, the inner hub 204 may cooperate with the outer wall 202 and retainer apertures 210 to concentrate and direct the fluid flow into the discharge chamber 42 through the recess passage 186, inner passage 206, and retainer apertures 210 thereby reducing or eliminating structural excitation (e.g., the excitation of the end cap 36 and/or partition 37) of the compressor 10. In this way, the configuration of the recess passage 186, inner passage 206, and retainer apertures 210 in the discharge valve assembly 28 cooperate to reduce turbulent fluid vibrations through the discharge valve assembly 28 and into the discharge chamber 42, thus reducing the operating noise of the compressor 10. In other words, the retainer portion 98 of the discharge valve assembly 28 may act as a muffler to decrease acoustic wave pulses in the discharge chamber 42 and resulting noise in the compressor 10. For example, in one particular example embodiments of the compressor 10, the retainer portion 98 and valve member portion 96 of the present discharge valve assembly 28 cooperate to decrease the sound level of the compressor 10 about 3-5 A-weighted decibels (dBA) as compared to a compressor having a conventional discharge valve assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a scroll including an end plate and a spiral wrap extending from the end plate, the end plate including a discharge passage; and a discharge valve assembly mounted to the scroll and configured to control fluid flow through the discharge passage, the discharge valve assembly including a backer, a valve member, and a retainer body, wherein:

the retainer body includes a top wall, an outer wall and an inner hub, wherein the outer wall is spaced apart from and surrounds the inner hub defining an annular inner passage therebetween in fluid communication with the discharge passage, wherein the backer is disposed between the valve member and the retainer body and defines a range of motion of the valve member, wherein the valve member is deflectable between a closed position in which the valve member restricts fluid flow through the discharge passage and an open position in which the valve member allows fluid flow through the discharge passage.

2. The compressor of claim 1, wherein the valve member is a reed valve having a fixed end and a movable end that deflects relative to the fixed end between the open and the closed positions.

3. The compressor of claim 1, wherein the discharge valve assembly includes a base fixed relative to the end plate, wherein the valve member is mounted to the base, and wherein the valve member is disposed between the base and the backer.

4. The compressor of claim 3, wherein a first side of the base includes a seat surface, and wherein a movable end of the valve member contacts the seat surface when the valve member is in the closed position and is spaced apart from the seat surface when the valve member is in the open position.

5. The compressor of claim 1, wherein an axial end of the retainer body engages a surface of the backer.

6. The compressor of claim 1, wherein the retainer body, the backer, and the valve member are disposed within a recess in the scroll.

7. The compressor of claim 6, wherein when the valve member is in the open position, working fluid flows through the discharge passage and through the retainer body before flowing through an aperture in a partition that separates a suction chamber of the compressor from a discharge chamber of the compressor.

8. The compressor of claim 1, wherein the top wall of the retainer body defines one or more apertures in fluid communication with the inner passage.

9. The compressor of claim 8, wherein the one or more apertures are slots.

10. The compressor of claim 9, wherein each of the slots includes a first end and a second end, and wherein the slots are curved between the first and second ends.

11. The compressor of claim 1, further comprising a shell assembly defining a suction chamber and a discharge chamber, wherein when the valve member is in the open position, working fluid flows through the discharge passage and through the inner passage of the retainer body to the discharge chamber.

12. The compressor of claim 11, wherein the top wall of the retainer body defines one or more apertures in fluid communication with the inner passage and the discharge chamber, and wherein when the valve member is in the open position, the one or more apertures allow fluid communication between the discharge passage and the discharge chamber.

13. The compressor of claim 1, wherein the scroll is a non-orbiting scroll.

14. A compressor comprising:

a shell assembly defining a suction chamber and a discharge chamber;

a scroll disposed within the shell assembly and including a first end plate and a first spiral wrap, the first end plate including a discharge passage and a discharge recess in fluid communication with the discharge chamber; and a discharge valve assembly mounted to the scroll and configured to control fluid flow between the discharge passage and the discharge chamber, the discharge valve assembly including a valve member, a backer, and a retainer body, the discharge valve assembly defining a first passage, a second passage, and a third passage, wherein:

the backer is disposed between the valve member and the retainer body, wherein the backer defines the first passage, wherein the first passage is in fluid communication with the discharge passage, the second passage is an annular passage defined by the retainer body, wherein the second passage is in fluid communication with the first passage and the third passage, the third passage includes one or more apertures formed in the retainer body, and the second passage is disposed between the first and third passages such that when the valve member is in an open position, fluid flows from the first passage to the second passage and subsequently though the third passage.

15. The compressor of claim 14, wherein, the backer defines a range of motion of the valve member, and the valve member is a reed valve that is deflectable relative to the first end plate between a closed position in which the valve member restricts fluid flow through the discharge passage and the open position in which the valve member allows fluid flow through the discharge passage.

16. The compressor of claim 14, wherein the discharge valve assembly includes a base fixed relative to the first end plate, wherein the valve member is disposed between the base and the backer, wherein the valve member contacts a seat surface of the base when the valve member is in a closed position and is spaced apart from the seat surface of the base when the valve member is in the open position.

17. The compressor of claim 14, wherein the one or more apertures are slots.

18. The compressor of claim 14, wherein the backer includes a pair of arms and a lobe portion, and wherein the first passage is defined by the pair of arms and the lobe portion.

19. The compressor of claim 14, wherein the retainer body, the backer, and the valve member are disposed within a recess in the scroll.

20. The compressor of claim 19, wherein when the valve member is in the open position, working fluid flows through the discharge passage, through the first passage, through the second passage and through the third passage before flowing through an aperture in a partition that separates the suction chamber from the discharge chamber.

* * * * *